US010434356B2

(12) United States Patent
Van Voorst

(10) Patent No.: US 10,434,356 B2
(45) Date of Patent: Oct. 8, 2019

(54) TRAINING APPARATUS FOR QUADRICEPS SETTING

(71) Applicant: Daniel Van Voorst, Yuma, AZ (US)

(72) Inventor: Daniel Van Voorst, Yuma, AZ (US)

( * ) Notice: Subject to any disclaimer, the term of this patent is extended or adjusted under 35 U.S.C. 154(b) by 122 days.

(21) Appl. No.: 15/628,439

(22) Filed: Jun. 20, 2017

(65) Prior Publication Data

US 2017/0368399 A1 Dec. 28, 2017

Related U.S. Application Data

(60) Provisional application No. 62/353,192, filed on Jun. 22, 2016.

(51) Int. Cl.
*A63B 21/02* (2006.01)
*A63B 21/00* (2006.01)
(Continued)

(52) U.S. Cl.
CPC ..... *A63B 21/028* (2013.01); *A61H 1/024* (2013.01); *A63B 21/0023* (2013.01); *A63B 21/00189* (2013.01); *A63B 21/4011* (2015.10); *A63B 23/03508* (2013.01); *A63B 23/0494* (2013.01); *A61H 2205/102* (2013.01);
(Continued)

(58) Field of Classification Search
CPC ..... A61H 1/024; A61H 2205/102; A63B 21/0023; A63B 21/00189; A63B 21/028; A63B 21/02; A63B 21/4011; A63B 21/4039; A63B 23/03508; A63B 23/0494; A63B 23/04; A63B 2208/0252; A63B 2208/0094
See application file for complete search history.

(56) References Cited

U.S. PATENT DOCUMENTS 5,131,408 A * 7/1992 Smith ..... A63B 21/0085 482/113
9,468,799 B1 * 10/2016 Ware ..... A63B 23/0482
(Continued)

OTHER PUBLICATIONS

Knee setting exercises Website: https://www.youtube.com/watch?v=9WolNw8UVbg published: Jul. 3, 2013 retrieved: Apr. 26, 2019 (Year: 2013).*

(Continued)

*Primary Examiner* — Megan Anderson
(74) *Attorney, Agent, or Firm* — Venjuris, P.C.

(57) ABSTRACT

Training apparatuses configured to receive, and conform to, the back of a user's knee and provide varying resistance and tactile feedback to a user performing quadriceps exercises and methods for using such apparatuses are disclosed herein. A preferred embodiment of the training apparatuses for quad sets comprises a solid, deformable, resilient body that includes a non-skid base and a top surface with a recess configured to receive the back of a user's knee. The body of this embodiment is preferably made of open-cell polyurethane foam with a uniform density ranging between 1 lb/ft$^3$ and 8 lbs/ft$^3$, and more preferably between 1.5 lbs/ft$^3$ and 4.5 lbs/ft$^3$. The embodiment provides gradually increasing resistance to compression, e.g. tactile feedback to the user's knee, when the user increasingly pushes his/her knee down against the embodiment, and thus allows dynamic quad setting and strengthening.

12 Claims, 2 Drawing Sheets

(51) Int. Cl.

| | |
|---|---|
| ***A61H 1/02*** | (2006.01) |
| ***A63B 23/04*** | (2006.01) |
| ***A63B 23/035*** | (2006.01) |
| ***A63B 21/002*** | (2006.01) |
| *A63B 22/00* | (2006.01) |

(52) U.S. Cl.

CPC ..... *A63B 21/02* (2013.01); *A63B 21/4039* (2015.10); *A63B 23/04* (2013.01); *A63B 2022/0094* (2013.01); *A63B 2208/0252* (2013.01)

(56) References Cited

U.S. PATENT DOCUMENTS

| | | | | |
|---|---|---|---|---|
| 10,130,836 | B2 * | 11/2018 | Madion | A63B 23/0211 |
| 2014/0318550 | A1 * | 10/2014 | Doci | A63B 21/00047 128/845 |
| 2015/0005145 | A1 * | 1/2015 | Zovich | A63B 23/1236 482/141 |
| 2017/0333744 | A1 * | 11/2017 | Chapman | A61H 1/024 |

OTHER PUBLICATIONS

Azo materials Azo materials (https://web.archive.org/web/20150304152740/https://www.azom.com/article.aspx?ArticleID=10535) archived: Mar. 4, 2015 retrieved: Apr. 23, 2019 (Year: 2015).*

* cited by examiner

TRAINING APPARATUS FOR QUADRICEPS SETTING

CROSS-REFERENCE TO RELATED APPLICATION

The present application claims priority to a U.S. provisional patent application entitled "Training Apparatus for Quadriceps Setting," having Ser. No. 62/353,192, filed on Jun. 22, 2016, which is entirely incorporated herein by reference.

BACKGROUND

Quadriceps setting (also known as quad sets) is an exercise for building and maintaining the strength of quadriceps which is essential for people with knee problems or after a knee surgery. Traditionally patients do quad sets by lying down or sitting on a surface with the problematic leg as straight as possible, then gently pushing the knee into the surface by tightening the thigh muscles (quadriceps), and holding the muscle contraction for a certain period of time.

This isometric contraction in quad sets can be painful and boring, and many patients tend to avoid reaching the knee's end range of motion if they anticipate pain. In addition, strengthening quadriceps by simply pushing the knee down and contracting quadriceps is a slow process. Therapists sometimes suggest placing a small towel roll under a patient's knee as a support as well as a marker of end range. But towel rolls do not provide a controlled resistance and tactile feedback to the patient that are consistent from one towel roll to another. Neither do towel rolls allow the patient to achieve full knee extension.

It is thus desirous to have a training tool for dynamic quad set that starts with a concentric contraction of the quadriceps and provides tactile feedback to a patient.

It also desirous that the training tool provides strengthening throughout the range as well as increased activation of the quadriceps at end range due to the tactile feedback.

SUMMARY

The structure, overall operation and technical characteristics of the present invention will become apparent with the detailed description of preferred embodiments and the illustration of the related drawings as follows.

The invention is incorporated in training apparatuses configured to support and conform to the back of a user's knee and provide varying resistance and tactile feedback to a user performing quadriceps exercises. A preferred embodiment of the training apparatuses for quad sets comprises a solid, deformable, resilient body that includes a base and a top surface with a recess configured to conform to the back of a user's knee.

The body of the preferred embodiment is preferably made of open-cell polyurethane foam. The base of the exemplary body is configured to support the embodiment and prevent any relative movement between the embodiment and the surface that the embodiment is placed on during the quad sets. The base is preferably cubical or of any shape that has a bottom at least as large as the top of the embodiment. The top surface of this exemplary body is preferably curved along a first axis with the middle portion of the top surface raised higher than its sides. The recess of this embodiment is located at the middle portion of the top surface, configured to receive the back of the user's knee, and preferably curved along a second axis perpendicular to the first axis.

When doing quad sets, the user first places the embodiment under the knee with the leg stretching along the first axis so that the embodiment holds the knee at its back with the recess. The user then pushes his/her knee down against the embodiment by the contraction of quadriceps. Since the embodiment has a resilient body, the body of the embodiment deforms when the user's knee pushes into it. The more the user presses the knee down, the more resistance to compression the embodiment provides, and the more tactile feedback the user's knee receives. As such, with the increasing tactile feedback, the embodiment provides dynamic quad setting and strengthening as well as increased activation of the quadriceps during the quad sets.

Alternate embodiments of the training apparatuses may adopt various designs and implementations. An embodiment may have a different shape or dimension. For instance, an exemplary embodiment may comprise a body having a substantially trapezoidal shape along the first axis with a flat top surface that includes a recess located in the middle of the top surface, cut along the second axis. Additionally, various embodiments may be made of different solid, deformable, resilient materials with various densities and deformation resistances to provide different levels of tactile feedback for strengthening and setting quadriceps. For instances, an embodiment may be made of resins, rubbers, or polyurethane foams, with a uniform density between 1 $lbs/ft^3$ and 8 $lbs/ft^3$, depending on how intense the quad sets are meant to be.

One object of this invention is to provide a training apparatus that conforms to and holds in place the back of a user's knee during quadriceps setting.

Another objection of this invention is to provide a training apparatus that gives dynamic tactile feedback to a user during quad sets.

BRIEF DESCRIPTION OF THE DRAWINGS OR PICTURES

DESCRIPTION OF THE EMBODIMENTS

Figure 1A:
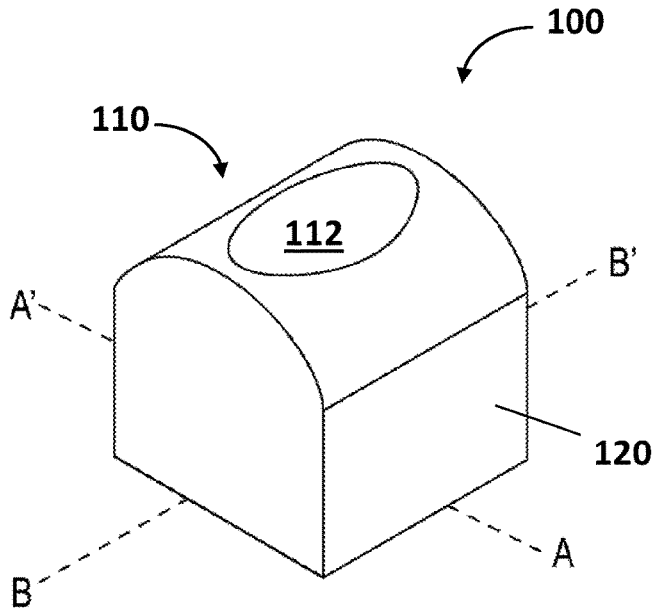
FIG. 1A shows the perspective view of a preferred embodiment.
Figure 1B:
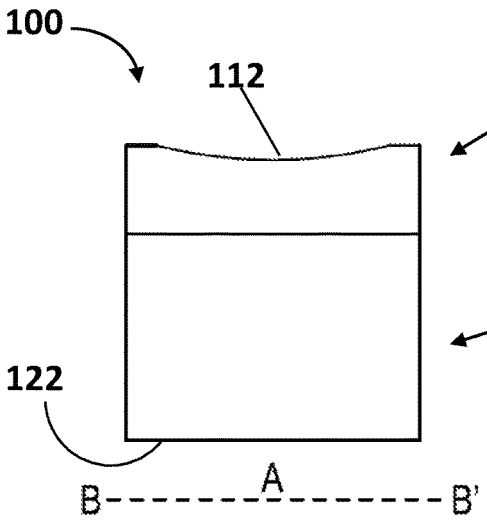
FIG. 1B shows a side view of the embodiment in FIG. 1A along the line A-A'.
Figure 1C:
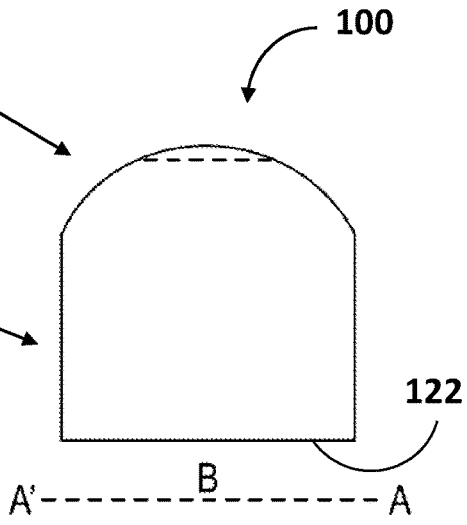
FIG. 1C shows a side view of the embodiment in FIG. 1A along the line B-B'.

The preferred embodiments are illustrated in FIGS. 1A-2C. A preferred embodiment (100) in FIGS. 1A-1C has a solid, deformable, resilient body with a top surface (110) with a recess (112) and a base (120) with a bottom (122). As shown in FIG. 1B, the top surface (110) of this embodiment (100) is a horizontal partial cylinder, extending along the line B-B' while curved along the line A-A', with the middle portion of the top surface (110) raised higher than the sides. The recess (112) of this embodiment (100) is located at the top surface (110) in the middle portion. The recess (112) is curved along the line B-B' which is perpendicular to the line A-A' so that the recess (112) conforms to the back of a user's knee when the user's leg rests on the embodiment (100) along the line A-A'.

An exemplary material of this preferred embodiment (100) is a solid open-cell polyurethane foam with a density ranging from 1.5 lbs/ft$^3$ to 4.5 lbs/ft$^3$. An exemplary dimension of this embodiment (100) is 5"×5"×5" with a 5"×5" bottom surface (122) of the base (120) contacting the surface the embodiment is placed on, the curve of the top surface (110), i.e. the perimeter of the horizontal partial cylinder (along the line A-A'), having a 2.83" radius, and the curved recess (112) having a 2.32" length (along the line A-A'), a 4" width (along the line B-B'), and a 0.25" height/depth.

Figure 2A:
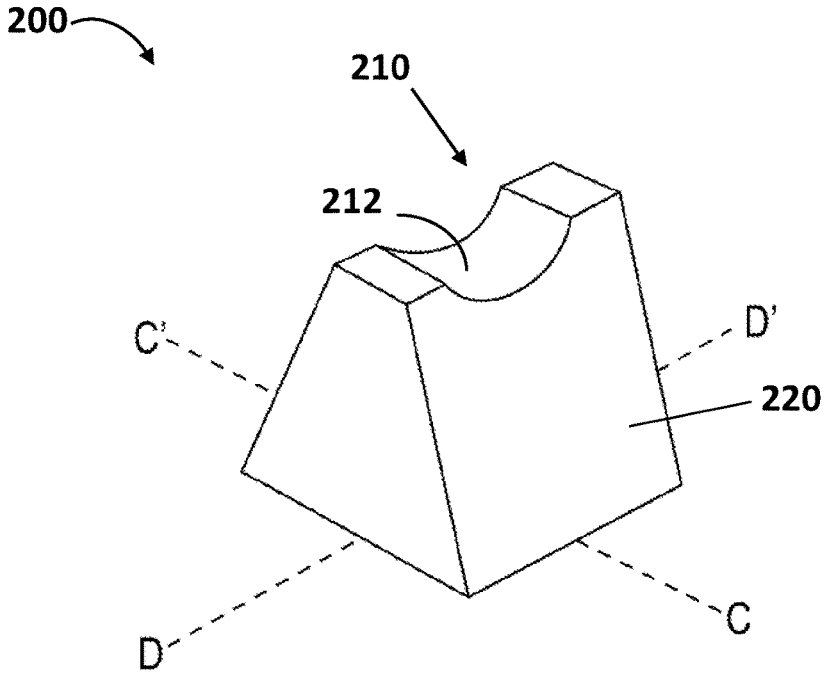
FIG. 2A shows the perspective view of an alternate preferred embodiment.
Figures 2B, 2C:
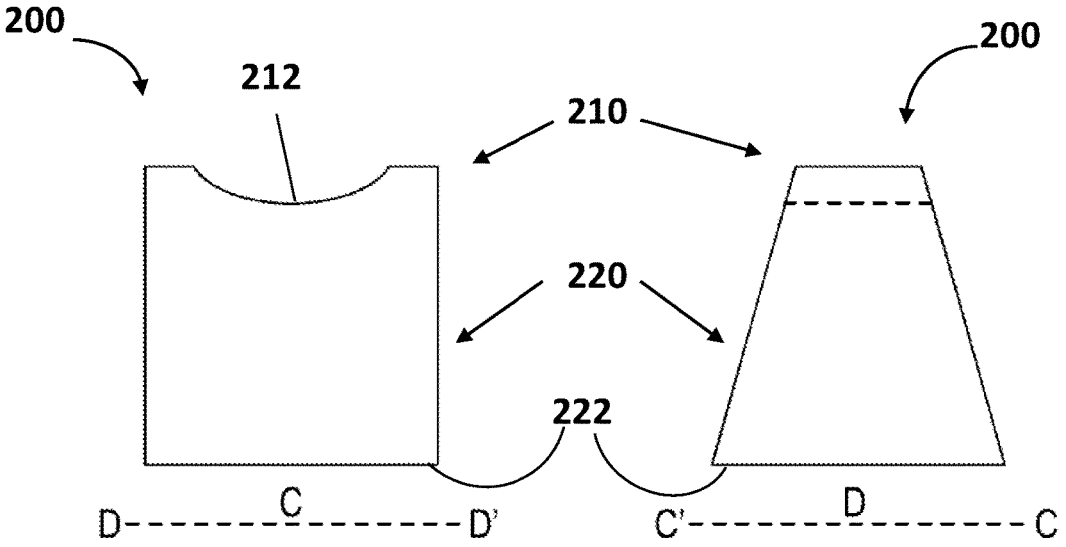
FIG. 2B shows a side view of the embodiment in FIG. 2A along the line C-C'.
FIG. 2C shows a side view of the embodiment in FIG. 2A along the line D-D'.

Another preferred embodiment (200) is illustrated in FIGS. 2A-2C. This embodiment (200) also has a top surface (210) with a recess (212) and a base (220). The body of this embodiment (200) is a trapezoid on the sides along the line C-C'. The top surface (210) in this embodiment (200) is flat and narrower than the bottom (222) of the base (220) along the line C-C', and the recess (212) is curved along the line D-D'. This embodiment (200) is also 5"×5"×5" in overall dimension and made of the same material as the previous embodiment (100) in FIGS. 1A-1C. Since this embodiment (200) has a smaller volume than that of the first embodiment (100), it thus would provide less deformation resistance and tactile feedback compared to the embodiment (100).

While the invention has been described by means of specific embodiments, numerous modifications and variations could be made thereto by those ordinary skilled in the art without departing from the scope and spirit disclosed herein. For instance, an exemplary body may have various densities, shapes, and dimensions in order to provide different resistances and tactile feedbacks. An exemplary body and its recess may additionally be of different shapes and dimensions in order to accommodate various sizes of the users' legs.

What is claimed is:

1. A training apparatus with a solid, deformable, resilient body for quadriceps setting, the solid, deformable, resilient body comprising:

(a) a uniform density between 1 lb/ft3 and 8 lbs/ft3;

(b) a top surface that is a horizontal partial cylindrical, extending and curving along a horizontal axis with a downward convex recess of uniform depth located at the middle of the top surface, perpendicular to the horizontal axis, configured to receive a back of a user's knee; and (c) a base with a flat anti-skid bottom, wherein the solid, deformable, resilient body is configured to provide resistance to compression to the user's knee when the user's knee pushes into the top surface, and an area of the flat anti-skid bottom of the base is at least as great as a vertical projected area of the top surface; and (d) the base is cubic with a dimension of 5"×5"×3.5" in length, width, and height; and (e) the top surface has a dimension of 5"×5"×1.5" in length, width, and height; and (f) the recess has a width of 4" along the horizontal axis and a depth of 0.25".

2. The training apparatus of claim 1, wherein the recess is convex downward, curved along the horizontal axis.

3. The training apparatus of claim 1, wherein the recess has a uniform depth along a horizontal direction perpendicular to the horizontal axis.

4. The training apparatus of claim 1, wherein the uniform density is between 1.5 lbs/ft3 and 4.5 lbs/ft3.

5. The training apparatus of claim 1, wherein the base further comprises two trapezoidal sides.

6. The training apparatus of claim 1, wherein the solid, deformable, resilient body is made of a material selected from polyurethane foam, resin, and rubber.

7. A method for setting a user's quadriceps with a training apparatus including a solid, deformable, resilient body with a uniform density, the method comprising the steps of:

(a) resting a user's knee on a recess of a top surface of the solid, deformable, resilient body, wherein the top surface of the solid, deformable, resilient body is horizontal partial cylindrical, extending along a horizontal axis, and the recess is located at a middle of the top surface the recess being configured to receive a back of the user's knee;

(b) gently pushing the user's knee downward into the recess by tightening the user's quadriceps and causing the solid, deformable, resilient body to deform which in turn provides a tactile feedback to the user's knee; and (c) holding contraction of the user's quadriceps, wherein the uniform density of the solid deformable, resilient body is between 1 lb/ft3 and 8 lbs/ft3, and the solid, deformable, resilient body further includes a flat non-skid bottom with an area at least as great as a vertical projected area of the top surface, (d) a base of the solid, deformable, resilient body is cubic with a dimension of 5"×5"×3.5" in length, width, and height and configured to support the top surface;

(e) the top surface has a dimension of 5"×5"×1.5" in length, width, and height; and (f) the recess has a width of 4" along the horizontal axis and a depth of 0.25".

8. The method of claim 7, wherein the recess is convex downward, curved along the horizontal axis.

9. The method of claim 7, wherein the recess has a uniform depth along a horizontal direction perpendicular to the horizontal axis.

10. The method of claim 7, wherein the uniform density is between 1.5 lbs/ft3 and 4.5 lbs/ft3.

11. The method of claim 7, wherein the body further comprises two trapezoidal sides.

12. The method of claim 7, wherein the solid, deformable, resilient body is made of a material selected from polyurethane foam, resin, and rubber.

* * * * *